US009155957B1

(12) United States Patent
Moody

(10) Patent No.: US 9,155,957 B1
(45) **Date of Patent: *Oct. 13, 2015**

(54) GAME SYSTEM

(71) Applicant: Richard L. Moody, Lutz, FL (US)

(72) Inventor: Richard L. Moody, Lutz, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/473,481

(22) Filed: Aug. 29, 2014

Related U.S. Application Data

(63) Continuation-in-part of application No. 14/026,866, filed on Sep. 13, 2013, now Pat. No. 9,017,179.

(51) Int. Cl.
*A63C 19/00* (2006.01)
*E01C 13/00* (2006.01)

(52) U.S. Cl.
CPC ..... *A63C 19/00* (2013.01)

(58) Field of Classification Search
CPC ..... E01C 13/00; E01C 13/08; E01C 3/003; A63C 19/00; A63C 19/02; A63C 19/08; A63C 2019/085; E04F 15/00; E04F 15/02
USPC ..... 472/92–94, 136; 256/25; 473/415
See application file for complete search history.

(56) References Cited

U.S. PATENT DOCUMENTS

| | | | | | |
|---|---|---|---|---|---|
| 4,819,582 | A * | 4/1989 | Lichvar | 119/474 |
| 5,050,867 | A * | 9/1991 | Rand et al. | 482/15 |
| 5,622,021 | A * | 4/1997 | Bookout | 52/582.1 |
| 5,738,588 | A * | 4/1998 | Esser | 472/92 |
| 6,004,218 | A * | 12/1999 | Keating et al. | 472/94 |
| 6,394,918 | B1 * | 5/2002 | Erhard | 473/421 |

* cited by examiner

*Primary Examiner* — Kien Nguyen

(57) ABSTRACT

A rectangular game field with two opposed parallel ends and two opposed parallel sides. Each side and each end are formed of rectangular panels having vertical and horizontal rails. Vertical extender rails extend upwardly from the rectangular panels. A plurality of variously shaped connectors couple together the rails of the rectangular panels and the extender rails. Stabilizer support panels extend outwardly from at least some of the rectangular panels. Flexible fabric netting is located between the rails of the rectangular panels and the extender rails. Straps separably couple the flexible fabric netting to the rectangular panels and the extender rails.

10 Claims, 11 Drawing Sheets

200
202
212
216
218
220
222
224
226
228
230
234
236
238
242
246
250
252
254
12A

GAME SYSTEM

RELATED APPLICATION

The present application is a continuation-in-part of pending application Ser. No. 14/026,866 filed Sep. 13, 2013, the subject matter of which is incorporated herein by reference.

BACKGROUND OF THE INVENTION

1. Field of the Invention

The present invention relates to a game system and more particularly pertains to fields which are readily assembled for playing games and disassembled for transportation and storage. The fields when assembled are arranged in rows and columns for conducting tournaments. The assembling and disassembling of fields, the playing of games, and the conducting of tournaments are done in a safe, convenient and economical manner.

2. Description of the Prior Art

The use of game fields of known designs and configurations is known in the prior art. More specifically, game fields of known designs and configurations previously devised and utilized for the purpose of providing a playing area for games are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, they do not describe a game system that allows fields to be readily assembled for playing games and disassembled for transportation and storage, the fields when assembled being arranged in rows and columns for conducting tournaments, the assembling and disassembling of fields and the playing of games and the conducting of tournaments being done in a safe, convenient and economical manner.

In this respect, the game system according to the present invention substantially departs from the conventional concepts and designs of the prior art, and in doing so provides an apparatus primarily developed for the purpose of providing fields which are readily assembled for playing games and disassembled for transportation and storage. The fields when assembled are arranged in rows and columns for conducting tournaments. The assembling and disassembling of fields, the playing of games, and the conducting of tournaments are done in a safe, convenient and economical manner.

Therefore, it can be appreciated that there exists a continuing need for a new and improved game system with fields which can be readily assembled for playing games and disassembled for transportation and storage, the fields when assembled being arranged in rows and columns for conducting tournaments, the assembling and disassembling of fields and the playing of games and the conducting of tournaments being done in a safe, convenient and economical manner. In this regard, the present invention substantially fulfills this need.

SUMMARY OF THE INVENTION

In view of the disadvantages inherent in the known types of game fields of known designs and configurations now present in the prior art, the present invention provides an improved game system. As such, the general purpose of the present invention, which will be described subsequently in greater detail, is to provide a new and improved game system and method which has all the advantages of the prior art and none of the disadvantages.

To attain this, the present invention essentially comprises a rectangular game field with two opposed parallel ends and two opposed parallel sides. Each side and each end are formed of rectangular panels having vertical and horizontal rails. Vertical extender rails extend upwardly from the rectangular panels. A plurality of variously shaped connectors couple together the rails of the rectangular panels and the extender rails. Stabilizer support panels extend outwardly from at least some of the rectangular panels. Flexible fabric netting is located between the rails of the rectangular panels and the extender rails. Straps separably couple the flexible fabric netting to the rectangular panels and the extender rails.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved game system which has all of the advantages of the prior art game fields of known designs and configurations and none of the disadvantages.

It is another object of the present invention to provide a new and improved game system which may be easily and efficiently manufactured and marketed.

It is a further object of the present invention to provide a new and improved game system which is of safe, durable and reliable constructions.

An even further object of the present invention is to provide a new and improved game system which is susceptible of a low cost of manufacture with regard to both materials and labor, and which accordingly is then susceptible of low prices of sale to the consuming public, thereby making such game system economically available to the buying public.

Lastly, another object of the present invention is to provide a game system for fields which are readily assembled for playing games and disassembled for transportation and storage. The fields when assembled are arranged in rows and columns for conducting tournaments. The assembling and disassembling of fields, the playing of games, and the conducting of tournaments are done in a safe, convenient and economical manner.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
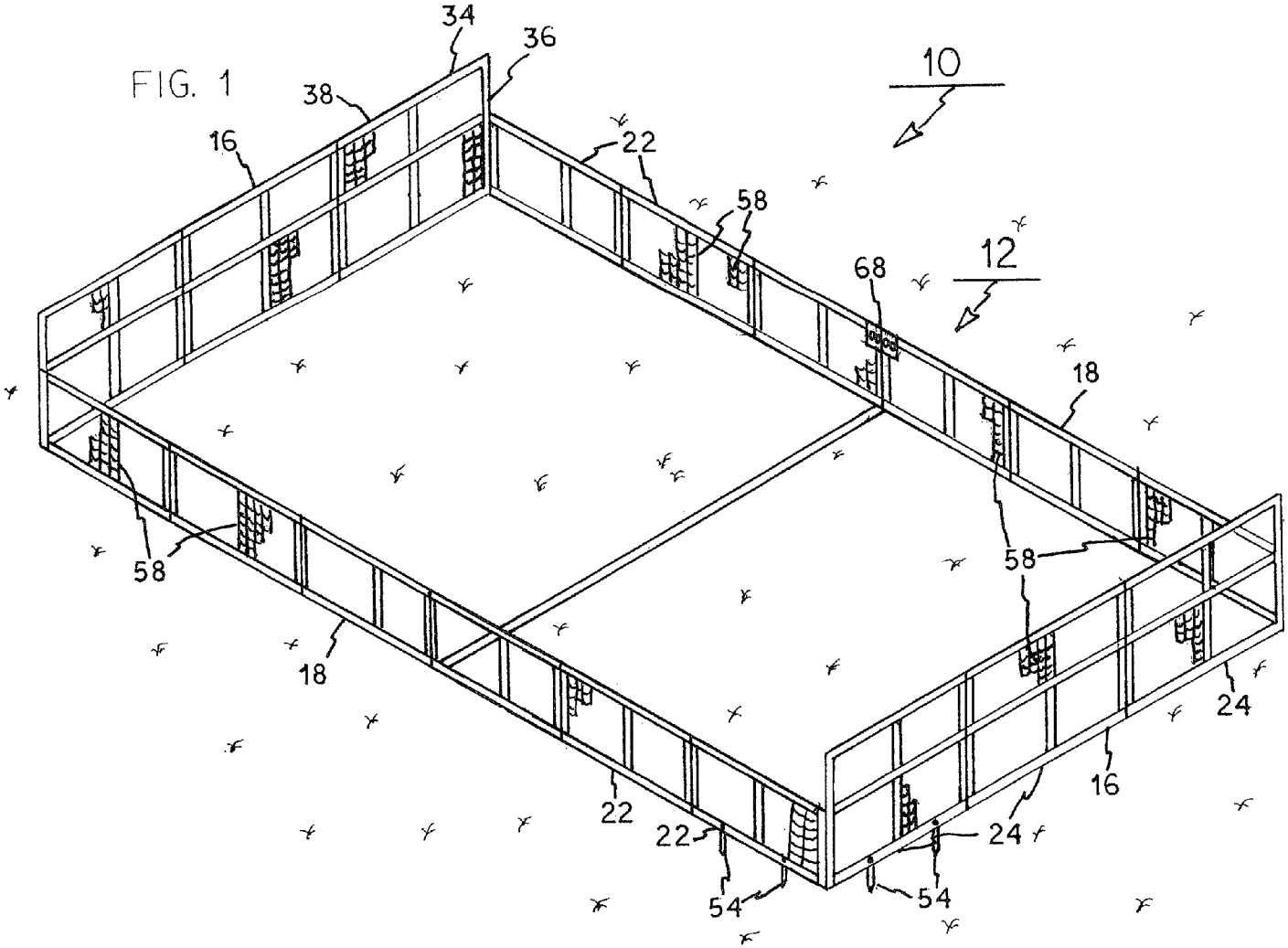
FIG. 1 is a perspective illustration of a dodge ball game field constructed in accordance with the principles of the present invention.
Figure 2:
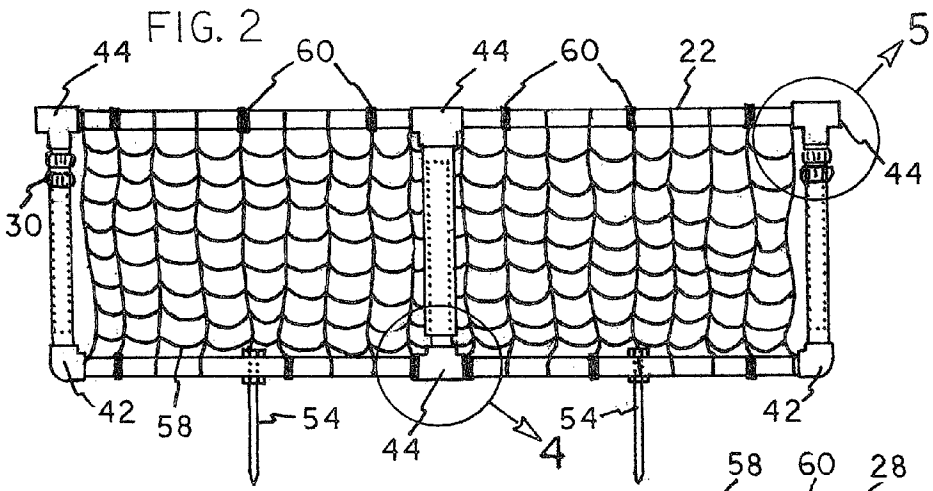
FIG. 2 is a plan view of a side panel in a collapsed orientation.
Figure 3:
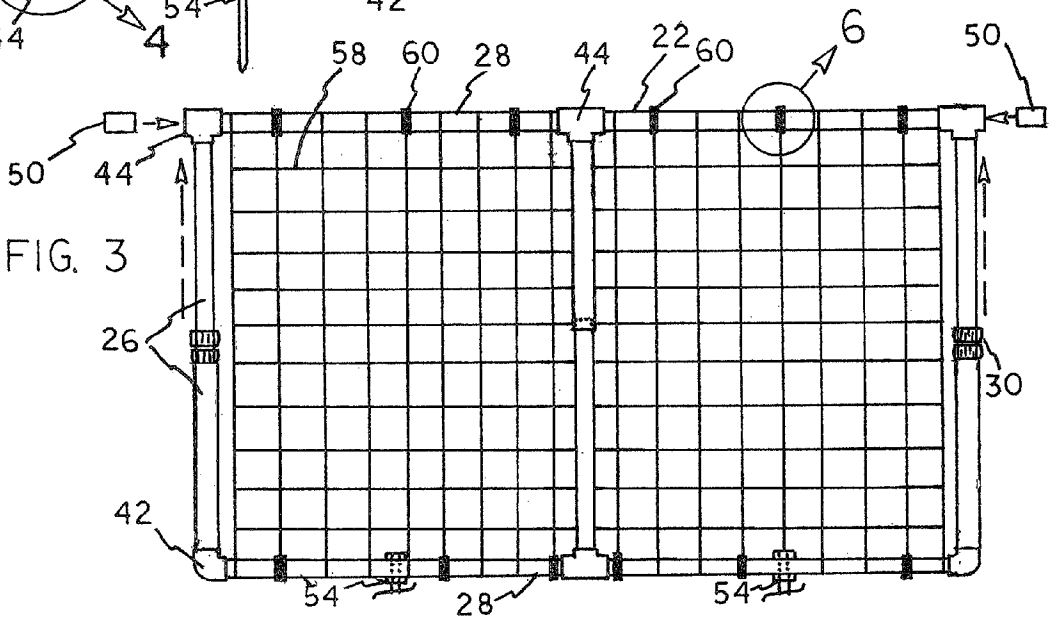
FIG. 3 is a plan view of a side panel in an extended orientation.
Figure 5:
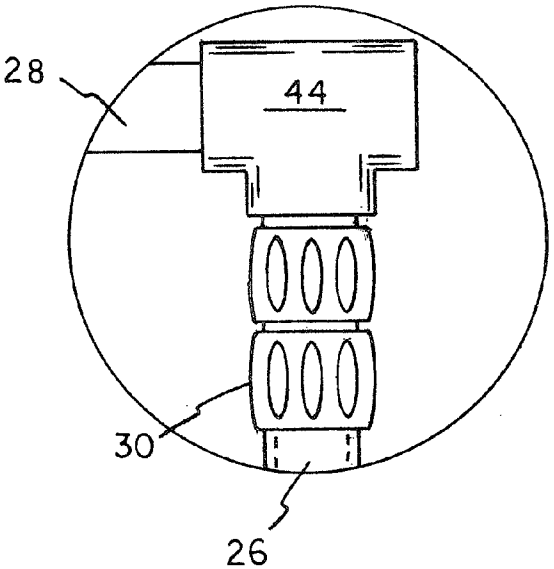
FIG. 5 is an enlarged showing of a portion of a side panel taken at circle 5 of FIG. 2.
Figure 6:
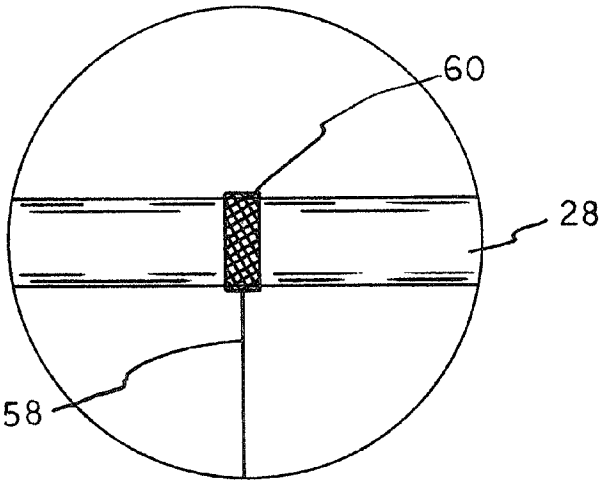
FIG. 6 is an enlarged showing of a portion of a side panel taken at circle 6 of FIG. 3.
Figure 4:
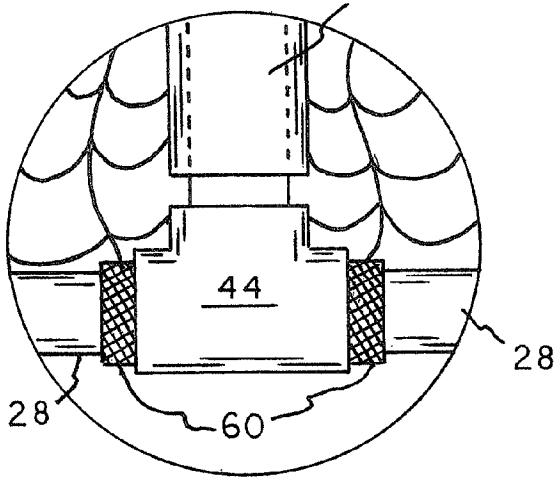
FIG. 4 is an enlarged showing of a portion of a side panel taken at circle 4 of FIG. 2.
Figure 7:
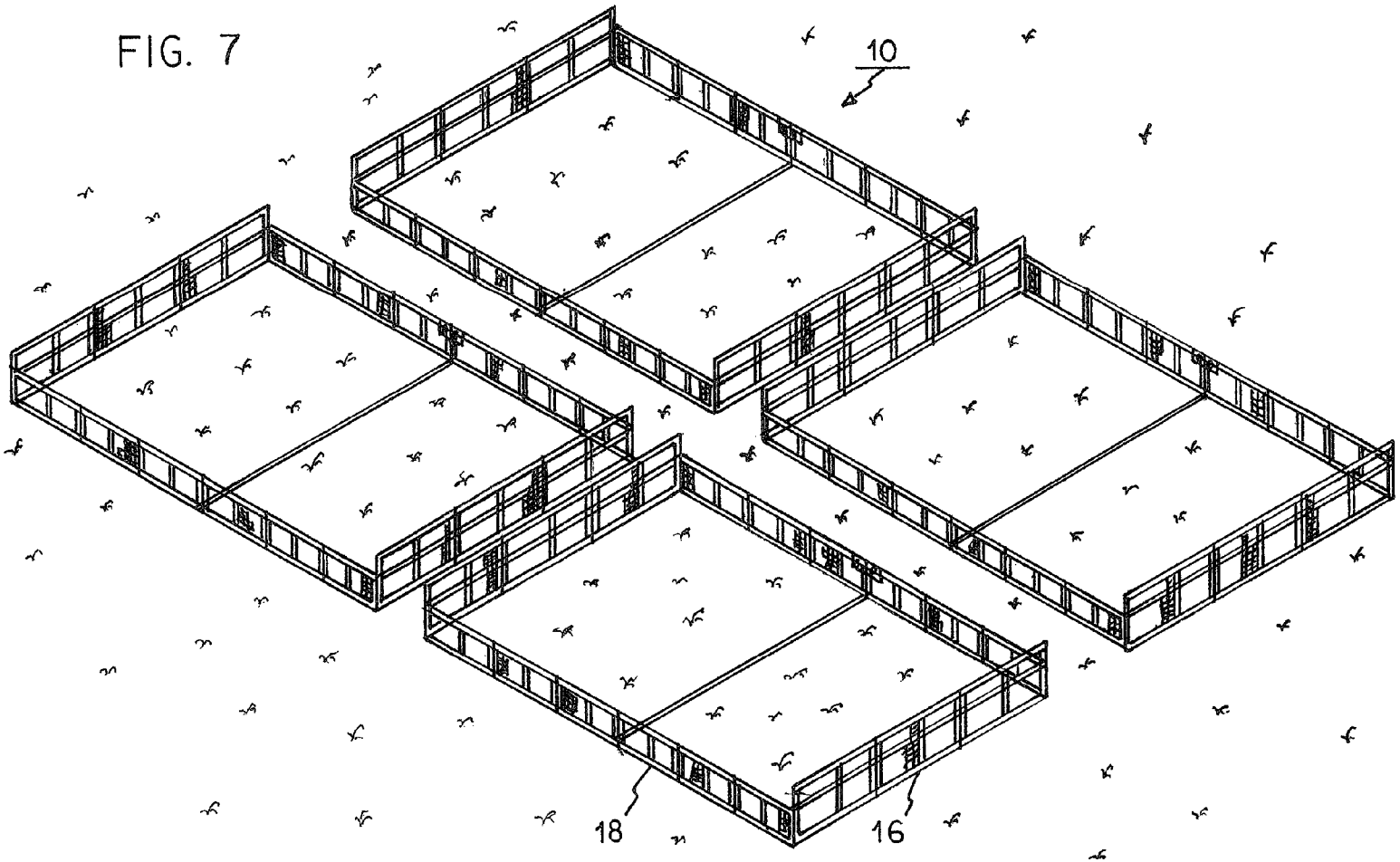
FIG. 7 is a perspective illustration of a game system formed of rows and columns of dodge ball game fields.
Figure 8:
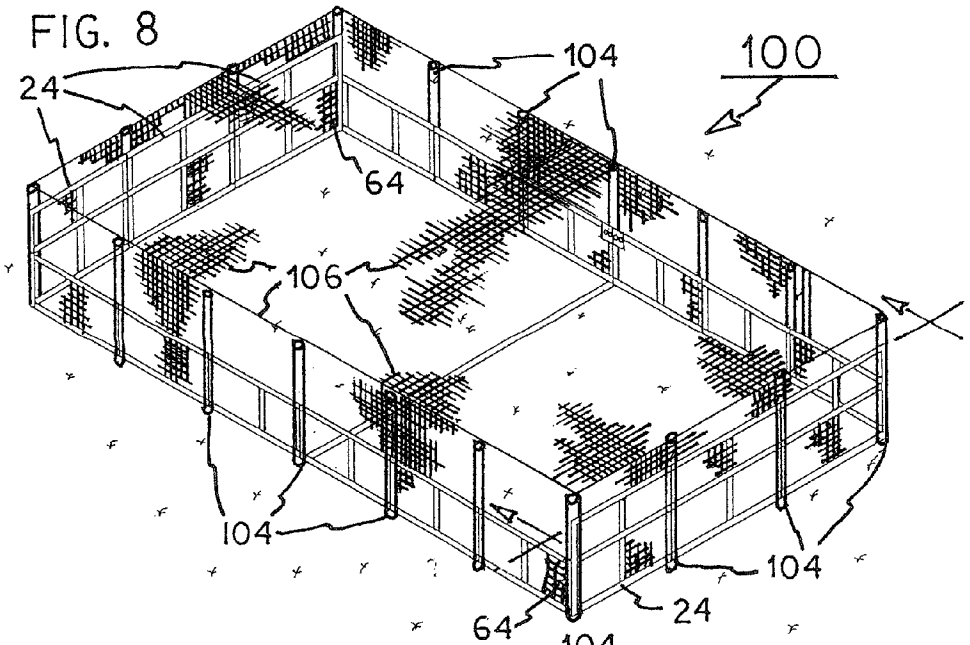
FIG. 8 is a perspective illustration of a dodge ball game field constructed in accordance with an alternate embodiment of the invention.
Figure 11:
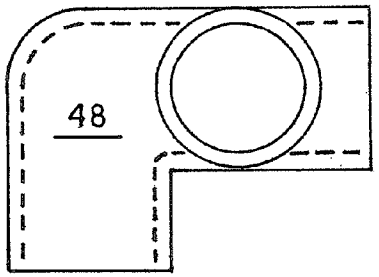
FIG. 11 is a plan view taken along line 11-11 of FIG. 10.
Figure 9:
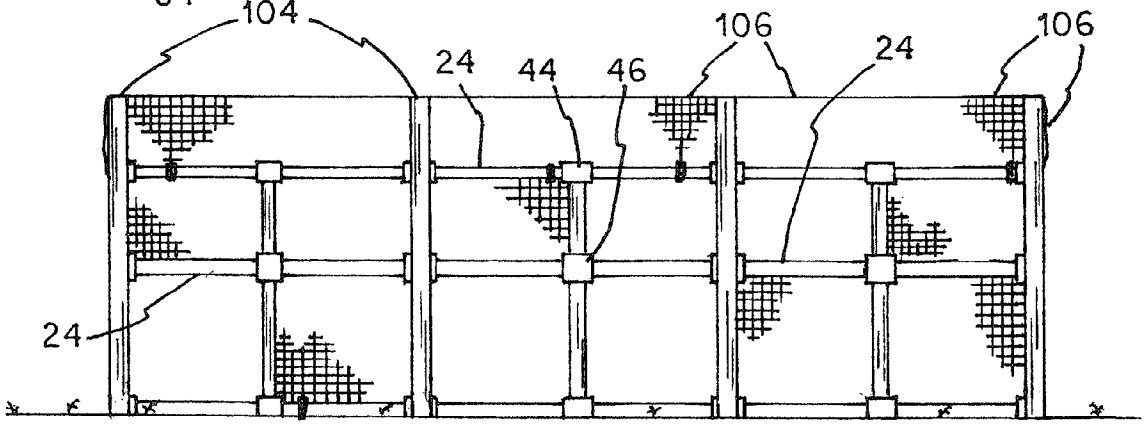
FIG. 9 is an end view of one end of the dodge ball game field of FIG. 8.
Figure 10:
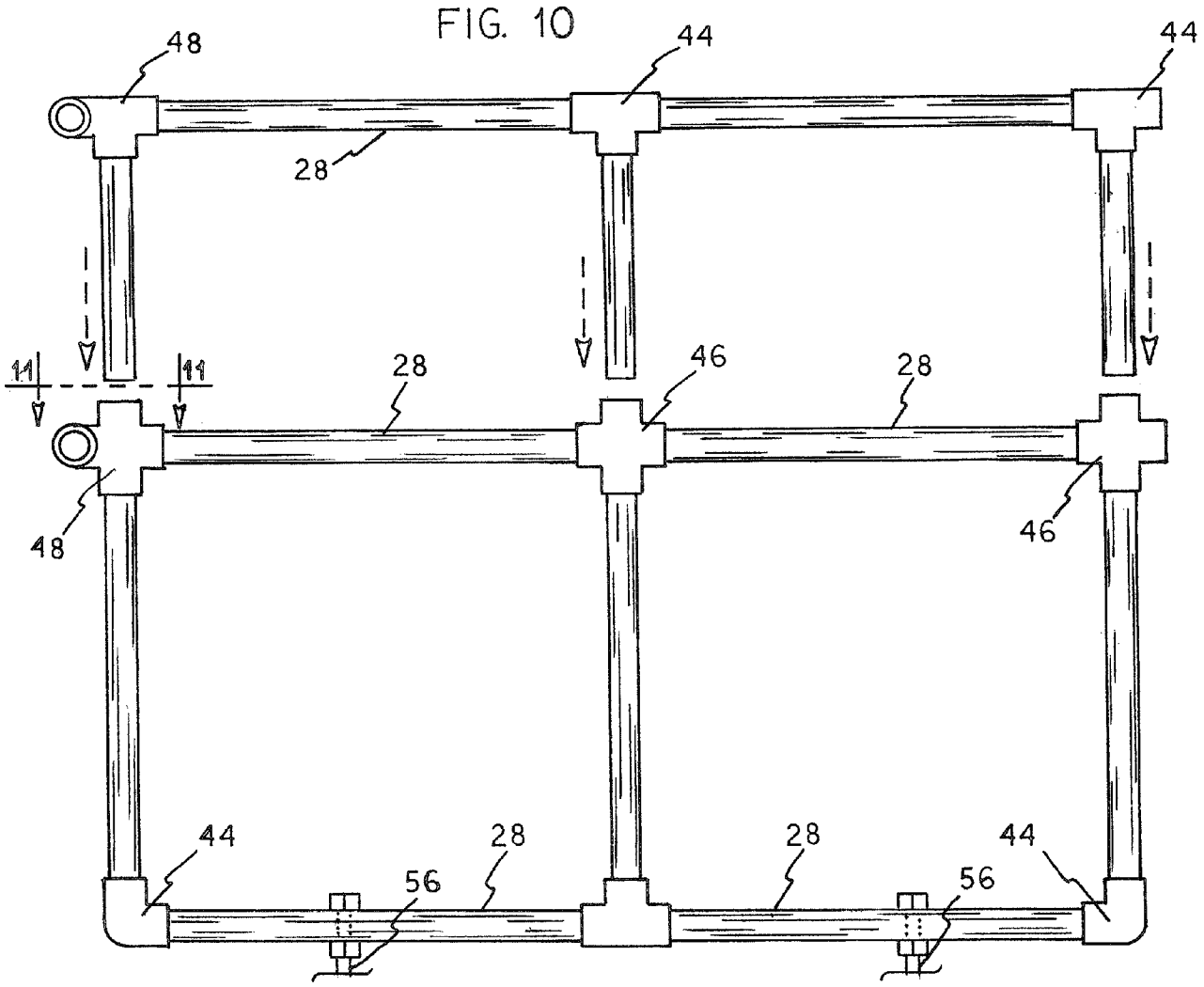
FIG. 10 is an enlarged exploded illustration of one panel shown in FIGS. 8 and 9.

With reference now to the drawings, and in particular to FIG. 1 thereof, the preferred embodiment of the new and improved game system embodying the principles and concepts of the present invention and generally designated by the reference numeral 10 will be described.

The present invention, the game system 10 is comprised of a plurality of components. Such components in their broadest context include a rectangular dodge ball field, rectangular panels, vertical extender rails, a plurality of connectors, flexible fabric, and straps. Such components are individually configured and correlated with respect to each other so as to attain the desired objective.

The game system 10 of the present invention is formed of a plurality of dodge ball fields 12. The fields are readily assembled for playing games and disassembled for transportation and storage. When assembled, the fields are arranged in rows and columns for conducting tournaments. The assembling and disassembling of fields, the playing of games, and the conducting of tournaments is done in a safe, convenient and economical manner.

Each dodge ball field 12 of the plurality of dodge ball fields is rectangular. Each dodge ball field has two similarly configured ends 16 spaced by a length of 64 feet. Each dodge ball field 12 has two similarly configured sides 18 spaced by a width of 32 feet.

Each side is formed of 6 side panels 22. Each end is formed of 3 end panels 24. Each side panel and each end panel are rectangular and has vertical rails 26 spaced by a width of 5 feet, 4 inches. Each side and each end panel has horizontal rails 28 with a height. The vertical rails are adjustable in length to vary the height of the side and end panels between a collapsed height of 2 feet 6 inches and an extended length of 5 feet. The vertical rails have locking components 30 to secure the vertical rails in a collapsed height for transportation and storage and in an extended height for use.

Each end panel has extender panels 34 formed of vertical extender rails 36, 3 feet in length and laterally spaced by a width of 5 feet 4 inches. Each extender panel has an upper horizontal extender rail 38 coupling adjacent vertical extender rails.

A plurality of variously shaped connectors are provided for coupling together rails of the side panels and the end panels and the extender panels. The various shaped connectors include L-shaped connectors 42, T-shaped connectors 44, cross-shaped connectors 46, cornering connectors 48 and nipple connectors 50.

Spikes 54 are provided attached to the side panels and the end panels and extending downwardly therefrom to securely couple the fields to ground. The spikes are adapted to be replaced by other securement components in order to facilitate playing on an indoor floor as of a gymnasium or the like.

Flexible fabric netting 58 is provided. The flexible fabric netting is located between the rails of the side panels and the end panels and the extender panels.

Next provided are straps 60. The straps have opposed ends with hook and loop fasteners separably coupling the flexible fabric netting to the side panels and end panels and extender panels. The flexible fabric netting is loose when in the collapsed orientation. The flexible fabric netting is taut when in the extended orientation.

At least one door 64 formed in a side panel adjacent to an end panel is next provided. The door is formed of flexible fabric netting coupled solely to and depending from a horizontal rail.

Lastly, a plurality of scoreboards 68 is provided. Each of the scoreboards is coupled to one of the sides of one of the playing fields facing inwardly at an elevated location equally spaced from the ends.

An alternate embodiment of the invention is illustrated in FIGS. 8-11. In this embodiment, the system 100 includes a plurality of vertically oriented poles 104 which are 10 feet high attached to, and extending upwardly from, the sides and the ends. Netting 106 which is 50 feet by 70 feet is draped over and supported by the poles. The netting covers the field.

The dodge ball game of the present invention is preferably played in tournament settings. It is about winning the most matches within a certain amount of minutes by eliminating all opposing players by getting them "OUT". The time is a running clock and does not stop until time is up. Two teams can play an unlimited amount of games within allotted time and for each win a team has, they will be given a point. When the time is complete the team with the most points wins the match. If the points are tied, the tie is broken by the most number of players in play when time ran out. If they are still tied, their game restarts with the current players in the game and will play until one team has one more player than the other.

A game consists of 4 players playing at a time. The game is played in an enclosed field. The boundaries are not markings but are the enclosed field netting. Normal boundaries are 32 feet by 64 feet, but can vary as needed.

There are multiple fields set up and all tournament matches utilize the same clock for time to determine when all games are complete. All matches that are being played are started and end at the same time. The sides are generally 5 feet high but can be higher or lower. The backs are generally 8 feet high but can be higher and as low as 5 feet.

In an alternate embodiment of the invention, the fields may be completely enclosed with netting covering the top, sides, and back with boundaries already in place, 10 foot high poles are placed along the outside perimeter of the arena 5 feet apart from each other. The cover netting is 50 feet by 70 feet and is held up by the 10 foot poles.

If a player hits the netting during a throwing or dodging action, that player is "OUT". There is no opening charge in the game, each team preferably starts with three balls but any number of balls could be utilized. There are no timeouts unless there is an injury. If one of the games is stopped due to an injury, all games are stopped because they all start and finish with the same time.

Figures 12, 12A:
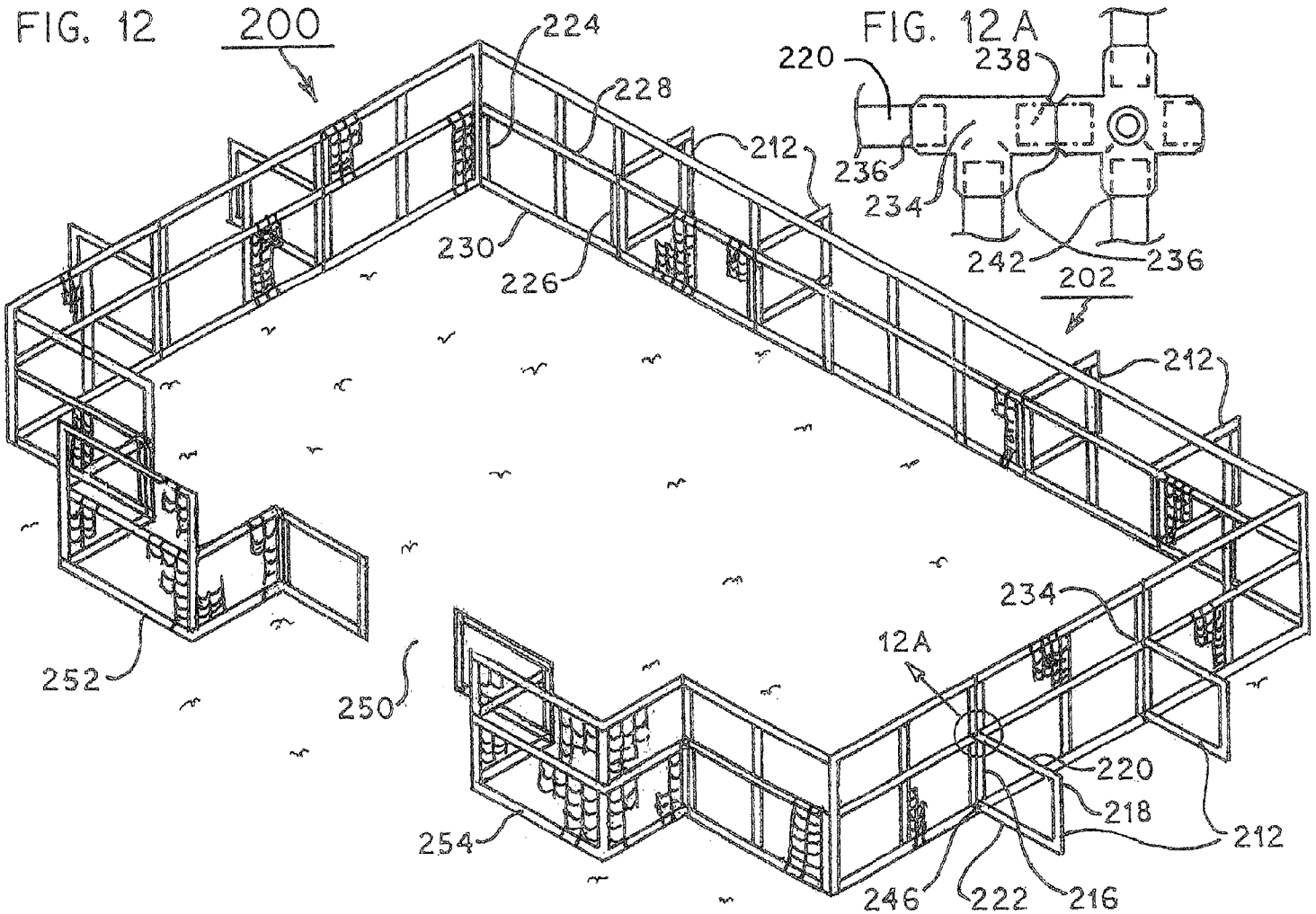
FIG. 12 is a perspective illustration of a dodge ball field constructed in accordance with an alternate embodiment of the invention.
FIG. 12A is an enlarged showing of the upper coupler taken at circle 12A of FIG. 12.
Figure 13:
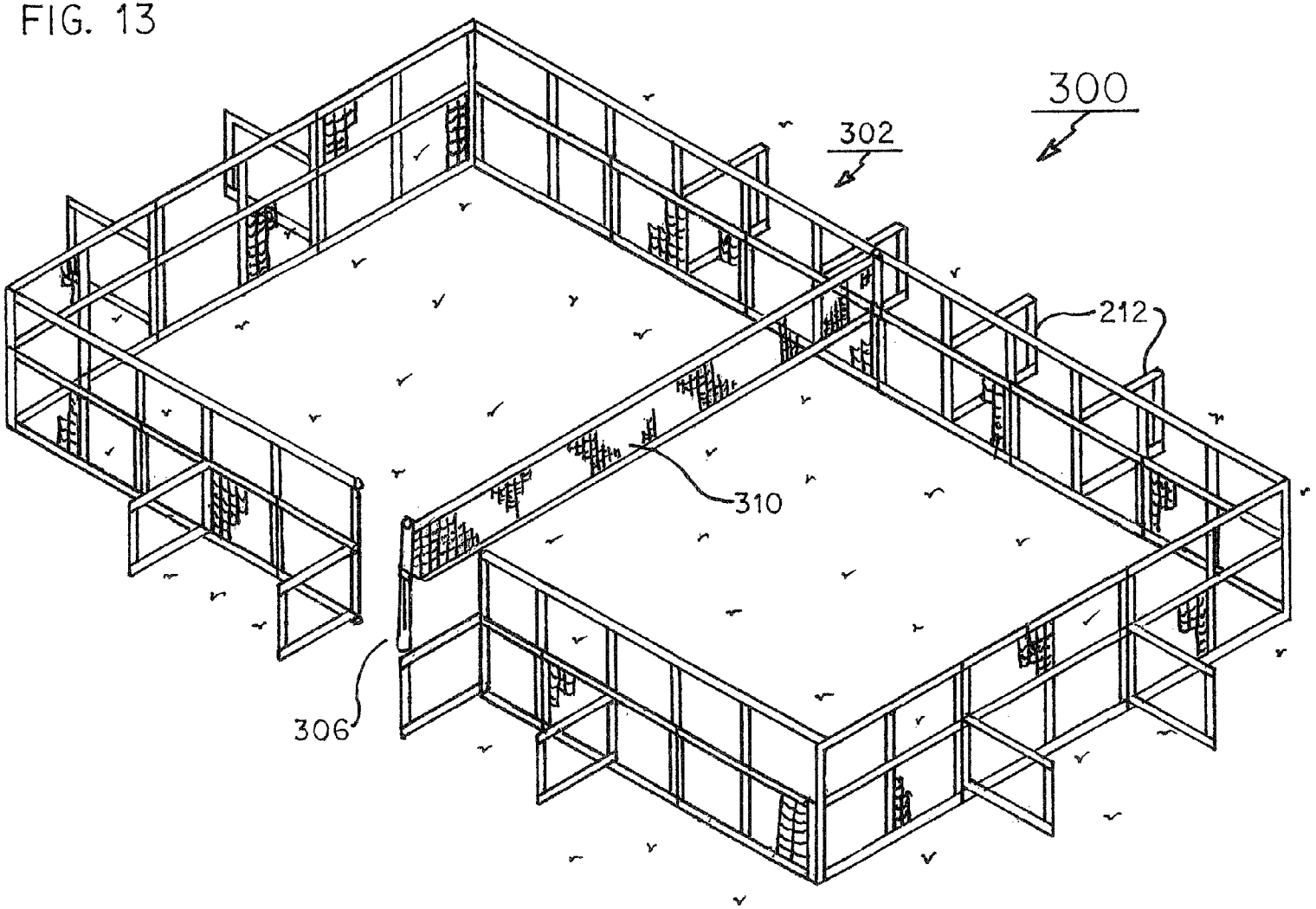
FIG. 13 is a perspective illustration of a volley ball field constructed in accordance with an alternate embodiment of the invention.
Figure 14:
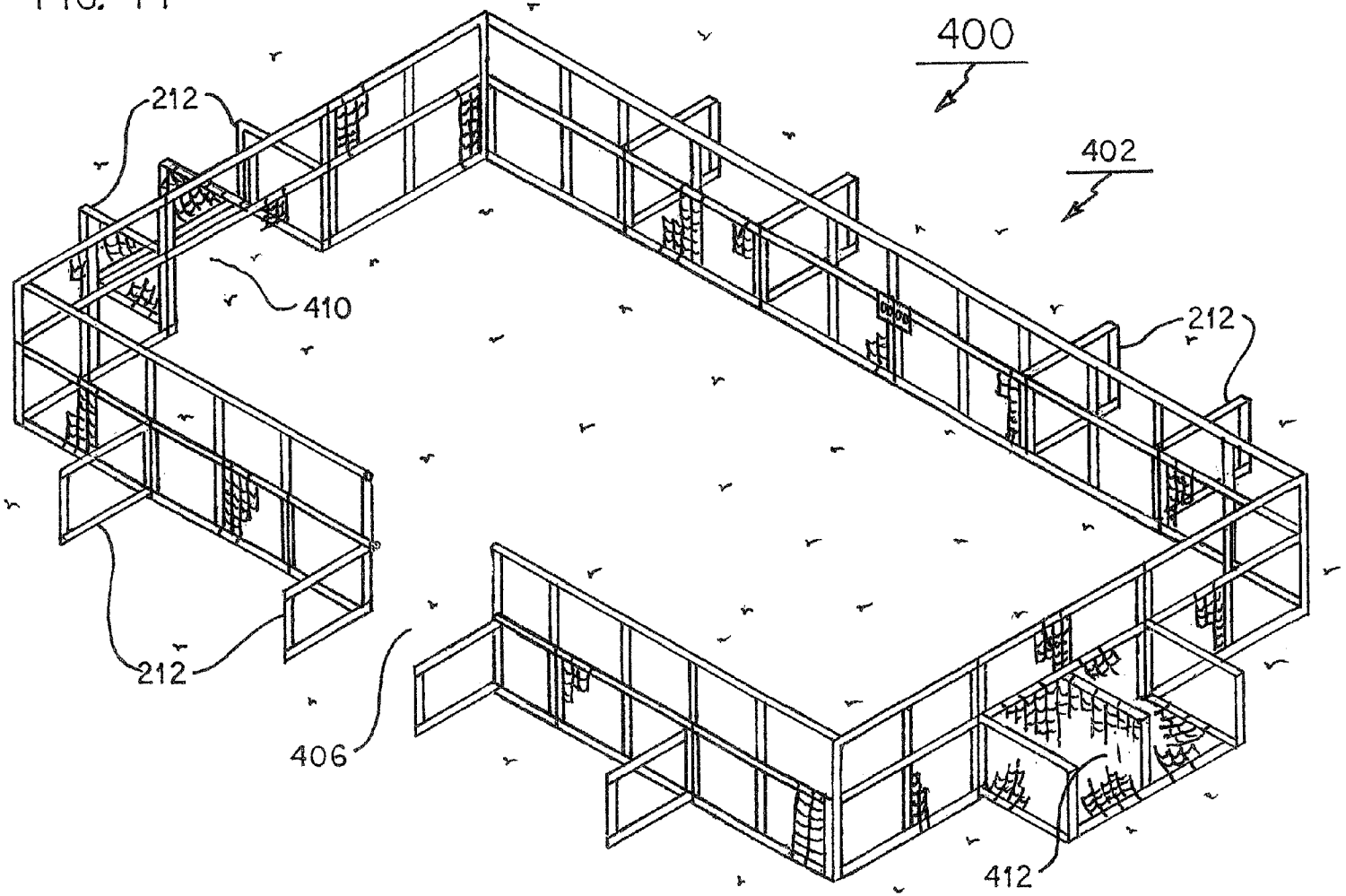
FIG. 14 is a perspective illustration of a soccer field constructed in accordance with an alternate embodiment of the invention.
Figure 15:
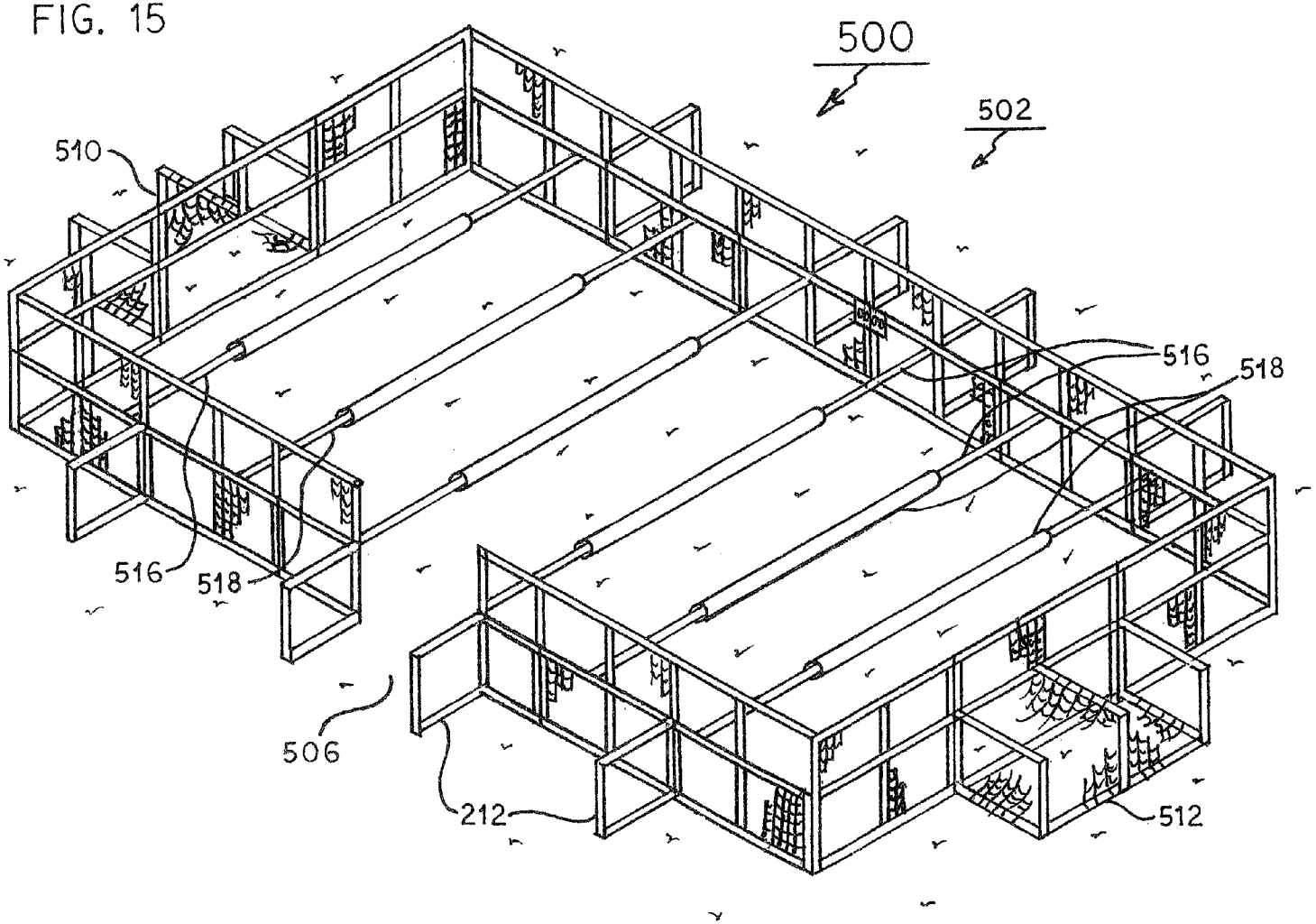
FIG. 15 is a perspective illustration of a foosball field constructed in accordance with an alternate embodiment of the invention.
Figure 16:
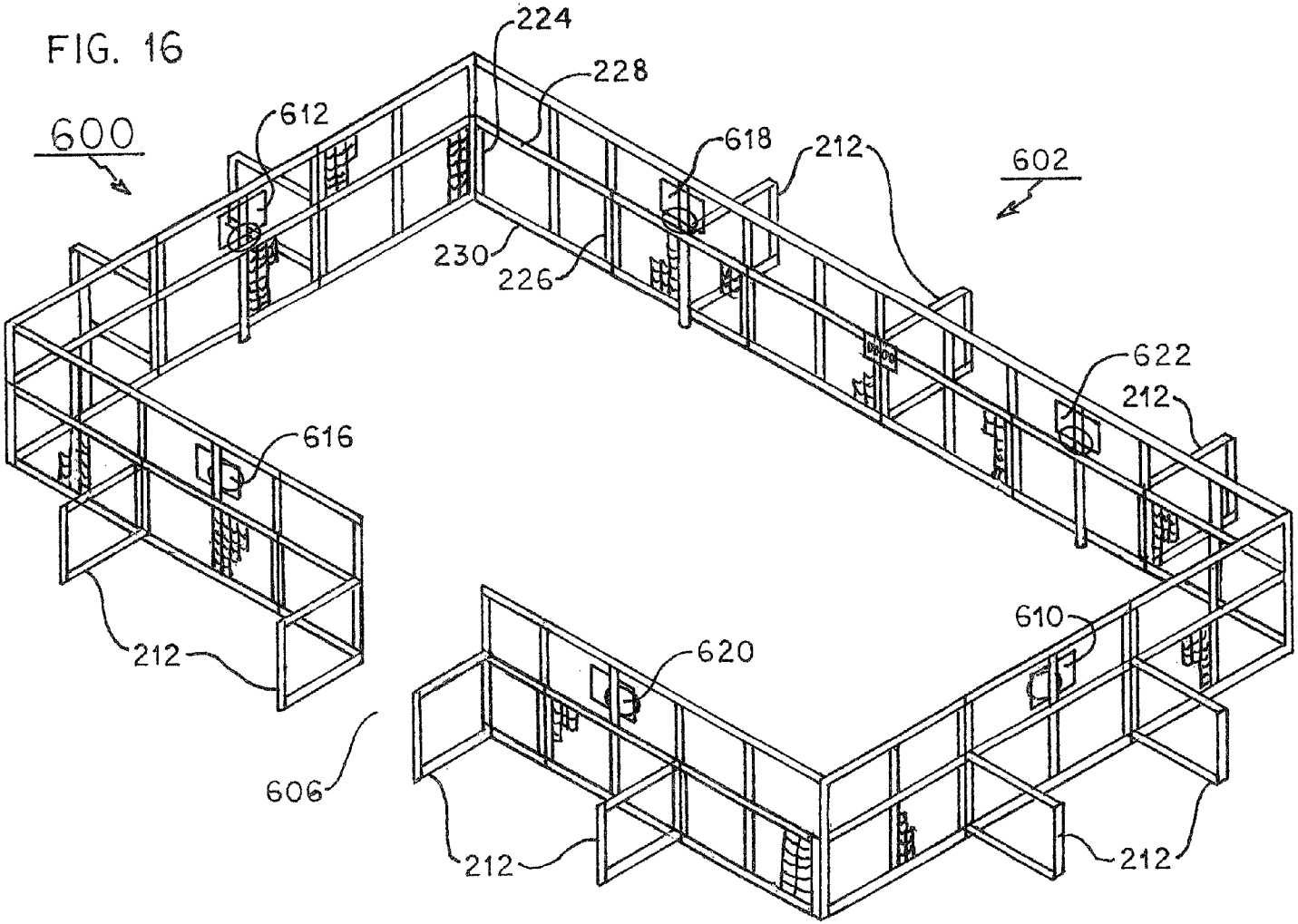
FIG. 16 is a perspective illustration of a basketball field constructed in accordance with an alternate embodiment of the invention.

Additional alternate embodiments of the invention are illustrated in FIG. 12, a dodge ball field, FIG. 13, a volley ball field, FIG. 14, a soccer field, FIG. 15, a foosball field, and FIG. 16, a basketball field.

As may be seen in FIG. 12, each stabilizer support panel 212 is rectangular in configuration with a vertical inner rail 216 and a vertical outer rail 218 and a horizontal upper rail 220 and a horizontal lower rail 222.

Each side panel and each end panel is formed of a vertical first rail 224 and a vertical second rail 226 and a horizontal upper rail 228 and a horizontal lower rail 230. The system further includes an upper coupler 234 having axially aligned bores 236 with stubs 238 coupled to the upper rails of adjacent rectangular panels. The upper coupler has a downwardly extending bore 242 coupled to an inner rail of a support panel. The system further includes a lower coupler 246 coupling the lower rails of adjacent rectangular panels. The lower coupler has an outwardly extending bore coupled to a lower rail of a support panel. The lower coupler is coupled to an upwardly extending inner rail of a support panel.

The game field of FIG. 12 is a dodge ball field 202 with a passage opening 206 and two rectilinear penalty areas 208, 210 which project outwardly from the dodge ball field. Two rectilinear penalty boxes are located on opposite sides of the passage opening.

The system 300 is a game field which is a volley ball field 302. Note FIG. 13. Such game field is constructed with a passage opening 306 and a net 310. The net is at a raised elevation and extends between the side walls midway between and parallel with the end walls.

In FIG. 14 the system 400 is a soccer field 402 constructed with a passage opening 406 and two goals 410, 412. Each of the two goals extends outwardly from an associated end walls equally spaced from the side walls.

In the system 500 of FIG. 15, the game field is a foosball field 502 constructed with a passage opening 506 and two goals 510, 512. Each of the two goals extends outwardly from an associated end walls equally spaced from the side walls. The foosball field has six rods 516 extending between and supported by the side walls. The six rods include three rods on opposite sides of the passage opening parallel with the end walls. A tube 518 is located on each of the six rods. The tubes are adapted to be grasped and held by players while kicking a ball toward a goal.

Lastly, the system 600 is illustrated in FIG. 16. In such system, the game field is a basketball field 602. Such field is constructed with a passage opening 606 and with two primary hoops 610, 612. Each of the two primary hoops extends upwardly from an associated end wall equally spaced from the side walls. The basketball field also has four secondary hoops 616, 618, 620, 622. The secondary hoops are located at elevated locations on the side walls laterally spaced between the end walls and the passage opening.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A sports system comprising:

a generally rectangular field having two opposed parallel ends and two opposed parallel sides;

each side and each end being formed of rectangular panels having vertical and horizontal rails;

vertical extender rails extending upwardly from the rectangular panels;

a plurality of variously shaped connectors for coupling together the rails of the rectangular panels and the extender rails;

stabilizer support panels extending outwardly from at least some of the rectangular panels;

flexible fabric netting located between the rails of the rectangular panels and the extender rails; and straps separably coupling the flexible fabric netting to the rectangular panels and the extender rails.

2. The system (200) as set forth in claim 1 wherein each stabilizer support panel (212) is rectangular in configuration with a vertical inner rail (216) and a vertical outer rail (218) and a horizontal upper rail (220) and a horizontal lower rail (222).

3. The system as set forth in claim 2 wherein each rectangular panel is formed of a vertical first rail (224) and a vertical second rail (226) and a horizontal upper rail (228) and a horizontal lower rail (230), the system further including an upper coupler (234) having axially aligned bores (236) with stubs (238) coupled to the upper rails of adjacent rectangular panels, the upper coupler having a downwardly extending bore (242) coupled to an inner rail of a support panel, the system further including a lower coupler (246) coupling the lower rails of adjacent rectangular, the lower coupler having an outwardly extending bore coupled to a lower rail of a support panel, the lower coupler coupled to an upwardly extending inner rail of a support panel.

4. The system (200) as set forth in claim 1 wherein the game field is a dodge ball field (202) with a passage opening (250) and two rectilinear penalty areas (252), (254), projecting outwardly from the dodge ball field, the rectilinear penalties being located on opposite sides of the passage opening.

5. The system (300) as set forth in claim 1 wherein the game field is a volley ball field (302) constructed with a passage opening (306) and a net (310), the net being in a raised elevation and extending between the side walls midway between and parallel with the end walls.

6. The system (400) as set forth in claim 1 wherein the game field is a soccer field (402) constructed with a passage opening (406) and two goals (410), (412), each of the two goals extending outwardly from an associated end walls equally spaced from the side walls.

7. The system (500) as set forth in claim 1 wherein the game field is a foosball field (502) constructed with a passage opening (506) and two goals (510)(512), each of the two goals extending outwardly from an associated end walls equally spaced from the side walls, the foosball field having six rods (516) extending between and supported by the side walls, the six rods including three rods on opposite sides of the passage opening parallel with the end walls, a tube (518) on each of the six rods, the tubes adapted to be grasped and held by players while kicking a ball toward a goal.

8. The system (600) as set forth in claim 1 wherein the game field is a basketball field (602) constructed with a passage opening (606) and two primary hoops (610)(612), each of the two hoops extending upwardly from an associated end wall equally spaced from the side walls, the basketball field having four secondary hoops (616)(618)(620)(622), the secondary hoops being located at elevated locations on the side walls laterally spaced between the end walls and the passage opening.

9. A dodge ball system (10) formed of a plurality of dodge ball fields (12), the fields being readily assembled for playing games and disassembled for transportation and storage, the fields when assembled being arranged in rows and columns for conducting tournaments, the assembling and disassembling of fields and the playing of games and the conducting of tournaments being done in a safe, convenient and economical manner, the system comprising, in combination:

each dodge ball field (12) of the plurality of dodge ball fields being rectangular and having two similarly configured ends (16) spaced by a length of 64 feet, each dodge ball field (12) of the plurality of dodge ball fields having two similarly configured sides (18) spaced by a width of 32 feet;

each side being formed of 9 side panels (22), each end being formed of 3 end panels (24), each side panel and each end panel being rectangular and having vertical rails (26) spaced by width of 5 feet 4 inches, each side and end panel having horizontal rails (28) with a height, the vertical rails being adjustable in length to vary the height of the side and end panels between a collapsed height of 2 feet 6 inches and an extended length of 5 feet, the vertical rails having locking components (30) to secure the vertical rails in a collapsed height for transportation and storage and in an extended height for use;

each end panel having extender panels (34) formed of vertical extender rails (36), 3 feet in length and laterally spaced by a width of 5 feet 4 inches, each extender panel having an upper horizontal extender rail (38) coupling adjacent vertical extender rails;

a plurality of variously shaped connectors for coupling together rails of the side panels and the end panels and the extender panels, the various shaped connectors including L-shaped connectors (42), T-shaped connectors (44), cross-shaped connectors (46), cornering connectors (48) and nipple connectors (50);

securement components (54) attached to the side panels and the end panels and extending downwardly therefrom to securely couple the fields to a recipient surface;

stabilizer support panels (212) extending outwardly from at least some of the side panels and at least some of the end panels;

flexible fabric netting (58) located between the rails of the side panels and the end panels and the extender panels;

straps (60) having opposed ends with hook and loop fasteners separably coupling the flexible fabric netting to the side panels and end panels and extender panels, the flexible fabric netting being loose when in the collapsed orientation and being taut when in the extended orientation;

at least one door (64) formed in a side panel adjacent to an end panel, the at least one door being formed of flexible fabric netting coupled solely to and depending from one of the horizontal rails; and a plurality of scoreboards (68), each scoreboard coupled to one side of one of the playing fields facing inwardly at an elevated location equally spaced from the ends.

10. The system as set forth in claim 9 wherein the securement components (54) are spikes and the recipient surface is the ground.

* * * * *